United States Patent [19]

Cosby

[11] 4,180,340

[45] Dec. 25, 1979

[54] BINDER POST CONNECTION

[75] Inventor: Billy Q. Cosby, Dalton, Ga.

[73] Assignee: National Service Industries, Inc., Atlanta, Ga.

[21] Appl. No.: 950,471

[22] Filed: Oct. 11, 1978

[51] Int. Cl.[2] ..... B42F 13/14

[52] U.S. Cl. ..... 402/63; 40/401; 402/68; 402/75

[58] Field of Search ..... 402/60, 68, 63, 75, 402/502; 403/68, 80; 40/104.13

[56] References Cited

U.S. PATENT DOCUMENTS

| | | | |
|---|---|---|---|
| 47,927 | 5/1865 | Burtnett et al. | 403/68 |
| 76,706 | 4/1868 | Brevoort | 403/68 |
| 1,397,577 | 11/1921 | Engelland | 402/68 X |
| 1,436,598 | 11/1922 | Marshall | 402/63 |
| 1,437,329 | 11/1922 | Wilburger | 402/60 X |
| 1,534,124 | 4/1925 | Kemp | 281/45 X |
| 1,582,405 | 4/1926 | Jennings, Jr. | 402/63 X |
| 1,584,460 | 5/1926 | Linskey | 402/63 |
| 2,439,826 | 4/1948 | Snyder | 402/63 X |
| 2,688,504 | 9/1954 | Parker | 403/80 |
| 3,181,390 | 5/1965 | Jay | 403/68 X |

FOREIGN PATENT DOCUMENTS

| | | | |
|---|---|---|---|
| 117648 | 5/1930 | Austria | 402/61 |

*Primary Examiner*—Robert L. Spicer, Jr.
*Attorney, Agent, or Firm*—B. P. Fishburne, Jr.

[57] ABSTRACT

A binder for carpet samples has a sturdy slotted anchor attached to the binder back with the anchor raised from the binder back in the region of the slot. A binder post has a head at one end for engagement within the slot by a swinging movement of the post relative to the anchor. A pair of lugs on the post and post head coact with the anchor slot to limit rotation of the post during installation. The end of the post away from the anchor is threaded and receives a nut placed above a top flap of the binder. Strength, durability, convenience and economy of manufacturing are featured.

7 Claims, 9 Drawing Figures

BINDER POST CONNECTION

BACKGROUND OF THE INVENTION

Binders for carpet samples or other thick and comparatively heavy sheets must satisfy strength and durability requirements which cannot be met by the customary types of binders used to store papers and files. To satisfy these special needs, one type of binder has been devised for carpet samples and the like which employs a binder post threaded at both ends and a cooperating anchor attached to the back of the binder and having a threaded opening receiving one end of the post. The far end of the post is received through an opening in a top flap of the binder and secured by a nut placed above the top flap. This structure is effective but it is also somewhat inconvenient to manipulate and therefore awkward. For example, when the securing nut is to be loosened from the binder post, undesired turning of the post relative to the anchor may occur. The customary prior art structure is also comparatively expensive to manufacture.

The present invention has for its object to improve on the above customary binder structure for carpet samples and the like through provision of a post and anchor connection which is cheaper to manufacture, more convenient and quicker to engage and disengage and which will resist turning of the post relative to the anchor when the nut is being manipulated. The improved arrangement sacrifices nothing in terms of the strength and durability required in a binder for thick carpet samples or other heavy materials.

Other advantages of the invention will become apparent during the course of the following detailed description.

To satisfy the disclosure requirements of 37 C.F.R. 1.56, the following known prior United States patents are made of record herein: U.S. Pat. Nos. 47,927; 76,706; 2,688,504; 3,181,390.

DETAILED DESCRIPTION

Figure 1:
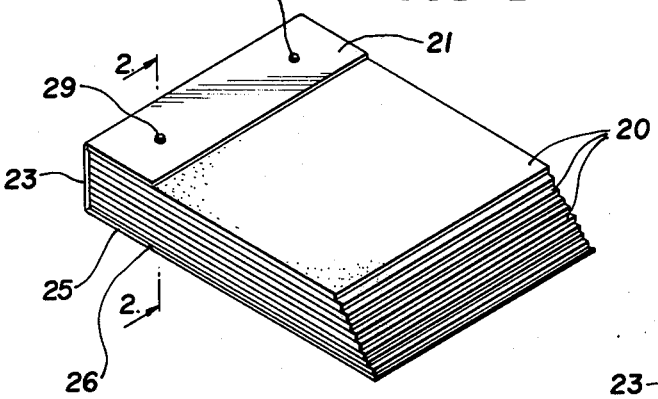
FIG. 1 is a perspective view of a binder for carpet samples embodying the invention.

Referring to the drawings in detail wherein like numerals designate like parts, rectangular carpet samples 20 are held in a binder constructed from stiff board and including a top flap 21 hinged at 22 to an edge portion 23, in turn hinged at 24 to a binder back 25 which may also have a hinge joint 26 formed across the same. The binder as thus far described is conventional. It may be equipped with a carrying handle, not shown, on the edge portion 23.

The samples 20 are held in the binder securely by a pair of sturdy posts 27 whose top ends are threaded at 28 to receive knurled tubular nuts 29, whose shanks 30 are received through the bores of metal grommets 31 set within openings of the top flap 21. This much of the construction is conventional.

Figure 3:
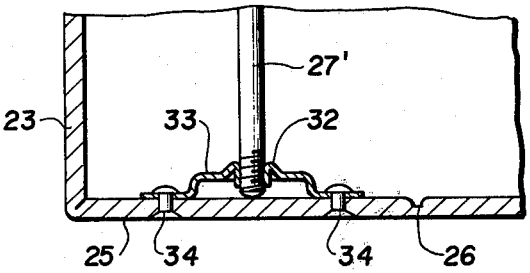
FIG 3 PRIOR ART
FIG. 3 is a fragmentary section, similar to FIG. 2, showing the prior art.

Referring to FIG. 3, showing the prior art, the lower end of each binder post 27' is also screw-threaded at 32 for engagement in a screw-threaded opening of a sheet metal anchor 33 fixed to the binder back 25 by rivets 34 or the like. The prior art arrangement has the drawback that there is nothing to prevent rotation of the post 27 in the threaded opening of the anchor 33 when the nut 29 is being applied or loosened. Also, an additional machining operation is required to form threads on the bottom of the post 27 and in the anchor 33. The present invention eliminates these threading operations, thus reducing cost, and more importantly, provides an arrangement whereby the binder posts 27 will not rotate during manipulation of the nut 29, thus adding greatly to the convenience of the binder. Also, as will become apparent, a new, quicker and more convenient mode of assembling the posts 27 with their anchors is provided under the invention.

Continuing to refer to the drawings, the invention further comprises a stamped metal anchor 35 for each post 27 having a raised central portion 36 and feet 37 which are secured to the back 25 by rivets 38 or equivalent fasteners.

In lieu of screw-threads, each post 27 is equipped at its lower end with a thin rounded circular head 39 and a pair of diametrically opposite tapering triangular lugs 40 integrally joined with the post 27 and the adjacent flat face of the head 39 which is perpendicular to the post axis. The lugs 40 extend radially of the post 27 to two points near and slightly inwardly of the periphery of head 39.

The cooperating anchor 35 has a mushroom-like slot 41 formed through its raised portion 36 centrally and this slot includes a roughly semicircular portion 42 and a right angular straight uniform width portion 43 having a rounded end. The radius of the slot portion 42 is slightly larger than the radius of post head 39 and the width of slot portion 43 is slightly greater than the diameter of the post 27.

Figure 2:
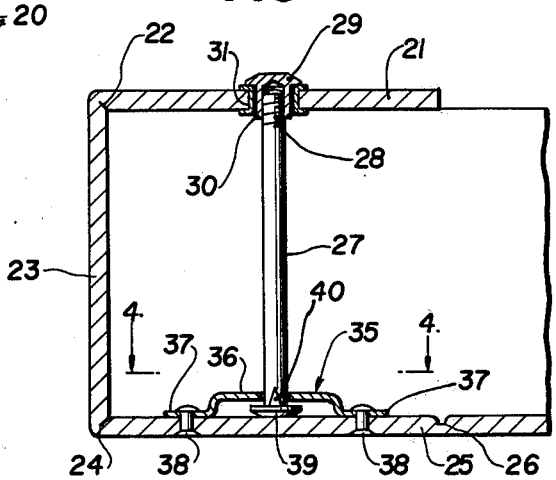
FIG. 2 is an enlarged vertical section taken through the binder on line 2—2 of FIG. 1.
Figure 4:
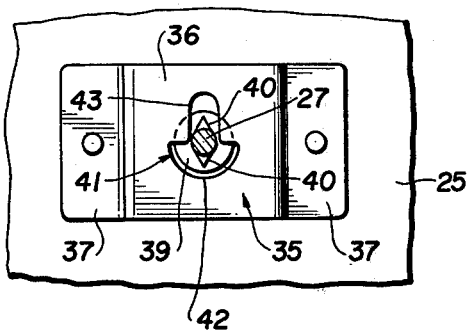
FIG. 4 is a horizontal section taken on line 4—4 of FIG. 2.
Figure 5:
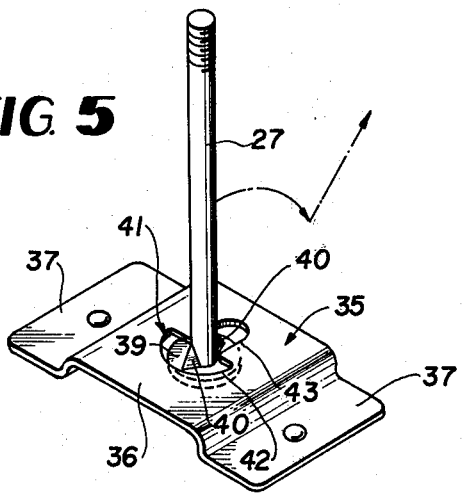
FIG. 5 is a perspective view of a binder post and slotted post anchor employed in the invention.
Figure 6:
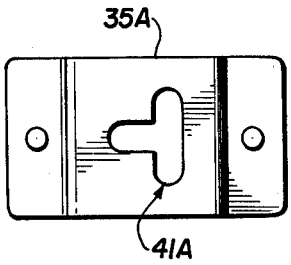
FIGS. 6 to 9 inclusive are plan views of alternate types of slots which may be employed in the anchor.
Figure 7:
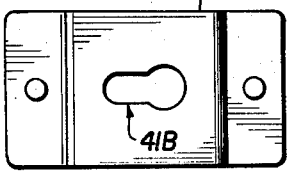
Figure 8:
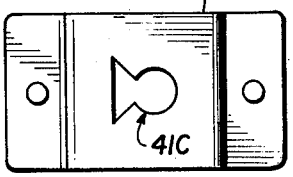
Figure 9:
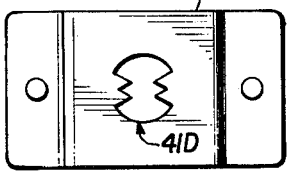

As depicted in FIG. 5, the post 27 is engaged with the anchor 35 and separated therefrom in the following manner. To engage or disengage the post with the anchor, the post is swung to an angle of about forty-five degrees relative to the raised portion 36 and the head 39 will pass through the slot portion 42 quite readily. The two triangular lugs 40 are aligned with the straight slot portion 43 and will therefore move into or out of the same readily. When the parts are being engaged for use, they will assume the relative positions shown in FIGS. 2 and 4 and the head 39 is held captive beneath raised anchor portion 36. The lugs 40 prevent significant rotation of the post relative to the anchor 35 during manipulation of the nut 29 through contact with the sides of straight slot portion 43. The post 27 and head 39 are loosely disposed relative to the anchor 35 for easy engagement and separation at required times by the described angling and swinging movement of the post and post head through the slot 41. However, when the carpet samples are in place on the two posts and the nuts 29 are tightened, the post heads 39 are locked rigidly against the bottom face of anchor portion 36 and cannot become separated from the anchor. The advantages of the construction over the prior art should now be readily apparent.

FIGS. 6 through 9 of the drawings simply illustrate alternate forms of post anchors 35*a*, 35*b*, 35*c* and 35*d* whose post head receiving slots 41*a*, 41*b*, 41*c* and 41*d* are variously shaped differently from the described mushroom slot 41, but all possessing a similar capability of receiving the head 39 and post 27 along with the two lugs 40 for the described purpose. Still other forms of anchor slots could be provided.

It should also be mentioned that the lugs 40 provide an alignment means or indicator for the proper assembling of the posts 27 with their anchors 35 in a blind situation. The lugs 40 must be aligned with slot portions 43 before the parts can be properly assembled.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. In a binder opposing binder sections adapted to receive between them elements to be bound, one binder section having an aperture, an anchor secured to the interior of the opposing binder section and having a raised portion spaced somewhat from the opposing binder section and being generally aligned with said aperture, said raised portion having a slot including generally right angular communicating slot portions, a binder post having a threaded end for passage through said aperture, a nut engageable with said threaded end and bearing on said one binder section, and a head on the far end of said post insertable through said slot to a position below said raised portion and also removable through said slot, and at least one lug joined to said post and head and entering one portion of the slot and resisting rotation of the post relative to said anchor around the axis of the post.

2. In a binder as defined in claim 1, wherein said slot is roughly mushroom-shaped including a roughly semi-circular portion and a straight portion of lesser width than the semi-circular portion and disposed at the transverse center of the semi-circular portion, and said head being coaxial with said post and having a diameter somewhat less than the maximum width of said mushroom-shaped slot across the semi-circular portion thereof.

3. In a binder as defined in claim 2, and said head being axially thin and somewhat rounded on its outer face and having a flat interior face perpendicular to the axis of the post.

4. In a binder as defined in claim 3, and said lug being tapered and roughly triangular in profile with an inclined edge thereof extending between the post and said flat interior face.

5. In a binder as defined in claim 4, and a second lug of like formation on the diametrically opposite side of said post and head.

6. In a binder as defined in claim 1, and a pair of said lugs on diametrically opposite sides of said post and head including inclined edges extending between the interior face of the head and opposite sides of the post.

7. In a binder as defined in claim 1 and including a pair of anchors secured to the interior of the opposing binder section in spaced relationship and each having said raised portion provided with said slot, a pair of posts and a pair of nuts, and each post having a head and a pair of lugs joining the head and post at diametrically opposite sides of the post, each post with its head being engageable with one anchor by arranging the post at an acute angle to said raised portion and passing the head into said slot with said lugs in alignment with one right angular slot portion and swinging each post to an upright engaged position substantially normal to the raised portion wherein said head is releasably locked beneath the raised portion.

* * * * *